United States Patent [19]

Giblin

[11] Patent Number: 4,574,945

[45] Date of Patent: Mar. 11, 1986

[54] CONVERTIBLE SHIPPING CASE

[75] Inventor: Susan B. Giblin, Pompton Lakes, N.J.

[73] Assignee: Lever Brothers Company, New York, N.Y.

[21] Appl. No.: 612,940

[22] Filed: May 21, 1984

[51] Int. Cl.[4] ..... B65D 90/04

[52] U.S. Cl. ..... 206/44 R; 229/16 D; 229/38

[58] Field of Search ..... 206/44 R; 229/16 R, 229/16 A, 16 D, 37 R, 37 E, 38, 44 R, 28 R; 220/416, 418

[56] References Cited

U.S. PATENT DOCUMENTS

| | | | |
|---|---|---|---|
| 2,598,123 | 5/1952 | Hollinshead | 229/44 R |
| 3,269,638 | 8/1966 | Forbes | 229/16 A |
| 3,815,809 | 6/1974 | Walters | 229/37 E |
| 3,825,174 | 7/1974 | Booth, Jr. | 229/28 R |
| 4,350,281 | 9/1982 | Dornbusch et al. | 229/38 |

*Primary Examiner*—Allan N. Shoap
*Assistant Examiner*—Bryon Gehman
*Attorney, Agent, or Firm*—Lynne Darcy; James J. Farrell

[57] ABSTRACT

A corrugated blank for being folded into a product shipping case and converted subsequently into a product display case is disclosed, the blank including in an appropriate location a pair of flaps which can be folded relative to and independently of certain panels of the blank into a position for shielding from the cutting edge of a blade the product contents of the case when the case is to be subsequently severed diagonally for purposes of removing the upper portion and displaying the contents without the need for their removal from the case.

6 Claims, 13 Drawing Figures

Fig. 4.
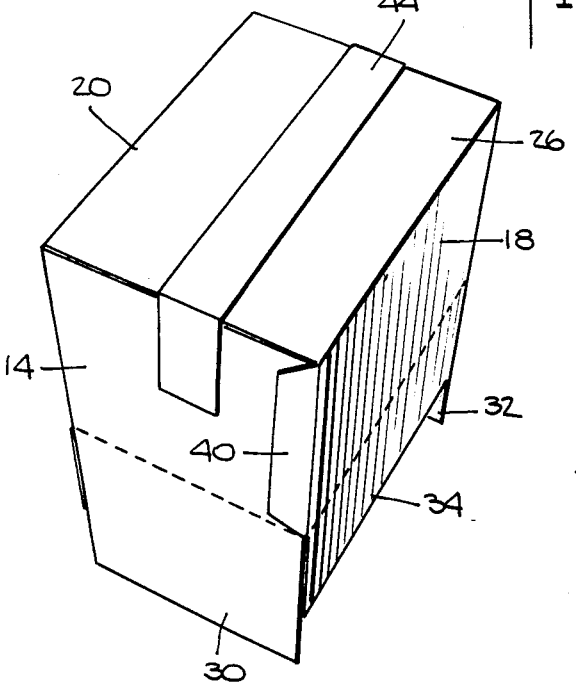
Fig. 5.
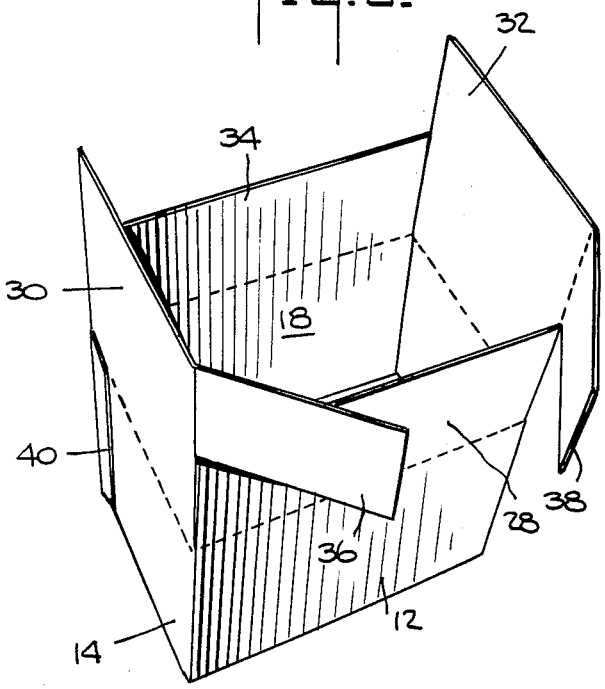
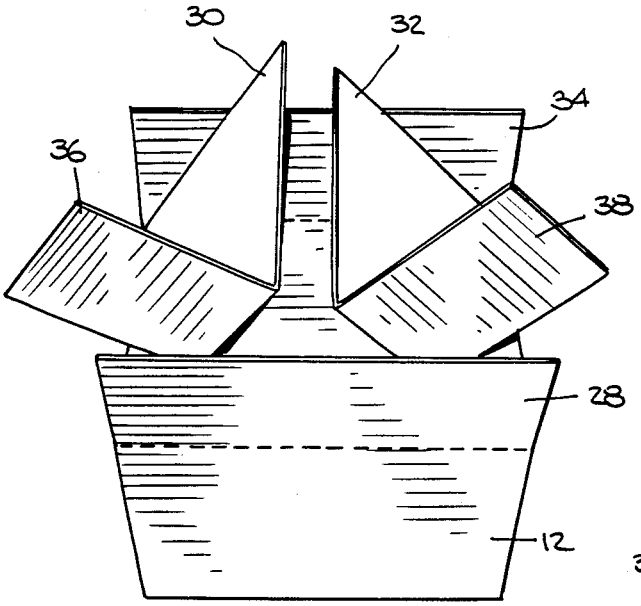
Fig. 6.
Fig. 7.
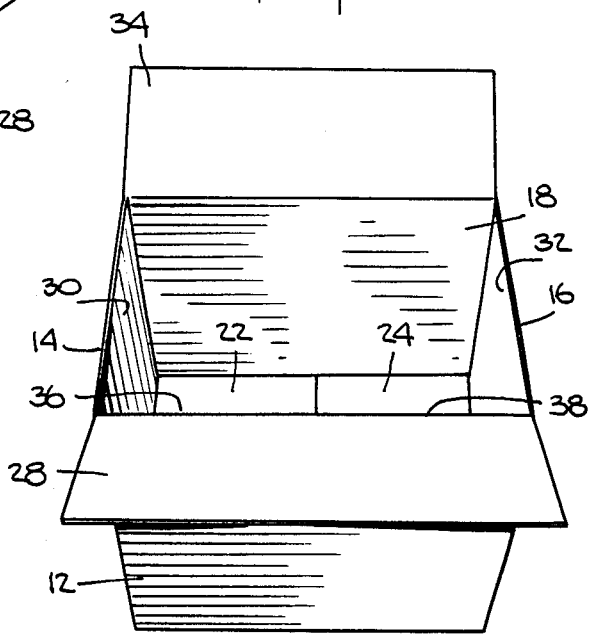

CONVERTIBLE SHIPPING CASE

BACKGROUND OF THE INVENTION

The present invention relates generally to shipping cases for bottles or containers and the like, and more particularly to a shipping case which can be converted into a display case for exposing the bottle contents therein without their removal from the case. The display function of the case is necessary for use in retail outlets, such as discount stores, supermarkets and pharmacies and the like to enable their proprietors to display selected products without shelving them.

Generally, the shipping cases are stacked one upon the other and the topmost shipping case is severed diagonally to remove the upper portion of the case from the lower portion and, thereby, expose the bottles or containers therein for selection by consumers. The severing process of the top portion from the bottom portion is generally effected with a knife or razor blade, and if not done carefully the knife edge can slice the bottles or labelling on the bottles or containers, thereby reducing their sales appeal to discriminating consumers.

In order to overcome this difficulty, what has been done conventionally is to place a liner (or corrugated fiberboard or the like) in surrounding relation about the bottles or containers internally of the case before the case is closed and sealed for shipping purposes. As a result, when the case is received in a sales outlet, the proprietor or his personnel can slice the case diagonally without the need for due care to remove the upper portion, the internal liner functioning to shield or protect the bottles or containers from the sharp edge of the blade.

A disadvantage associated with providing such a liner in a case is that the case must be treated or processed with an additional step of inserting the liner, thereby requiring unnecessary equipment, materials and expense. It is this and other disadvantages associated with conventional packaging that the present invention is directed at overcoming.

SUMMARY OF THE INVENTION

It is therefore the object of the present invention to provide a corrugated blank having appropriate protective flaps which are integral therewith and can be folded into a protective condition relative to other panels or flaps of the blank when the latter is formed into a case. The bottles or containers which are then to be inserted into the case can be so inserted in a separate stage without the attendant need of also inserting between the bottles and the interior of the case an additional liner. This arrangement obviates the necessity of otherwise providing extraneous and unnecessary materials for protective measures which are costly and require equipment and handling independently of fabricating the case itself.

The present invention may, therefore, be characterized as a corrugated fiberboard blank for being folded into a product shipping case and converted subsequently into a product display case, the blank including in an appropriate location a pair of flaps which can be folded relative to and independently of certain panels of the blank into a position for shielding from the cutting edge of a blade the product contents of the case when the case is to be subsequently severed diagonally for purposes of removing the upper portion and displaying the contents without the need for their removal from the case.

BRIEF DESCRIPTION OF THE DRAWINGS

Further objects and advantages of the invention will become apparent from the following description and accompanying drawings in which:

FIG. 4 is a perspective view of the next stage of folding the case following that of FIG. 3;

FIG. 5 is a perspective view of the case illustrated in FIG. 4 now turned over once again to expose the top thereof;

FIG. 6 is a perspective view of the case assembly following that of FIG. 5, and illustrating the protective flaps or ears of the present invention;

FIG. 7 is a perspective view of the case in an open condition following insertion of the protective flaps illustrated in FIG. 6;

DETAILED DESCRIPTION OF THE INVENTION

A. Structure

Figure 1:
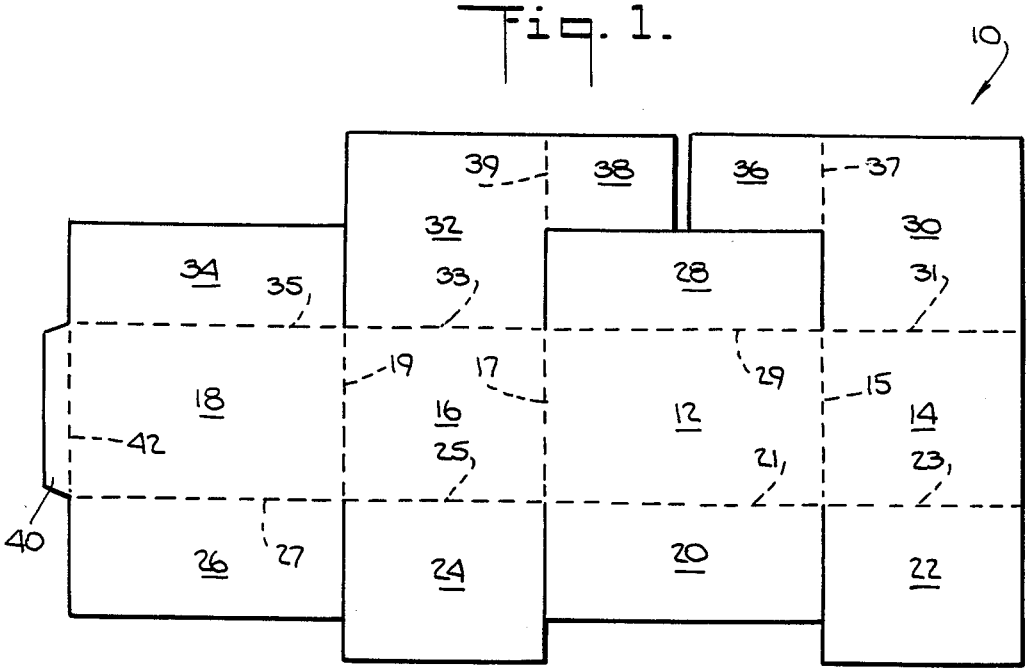
FIG. 1 is a plan view illustrating one embodiment of the blank of the present invention before folding.

Referring now to the drawings, and more particularly to FIG. 1, the present invention comprises a blank made, for example, of corrugated fiberboard. The blank is generally denoted by reference character 10. The blank 10 includes a front panel 12, a first side panel 14, a first score line 15 interconnecting the first side panel 14 to the front panel 12, a second side panel 16, and a second score line 17 interconnecting the second side panel 16 to the front panel 12 and extending parallel to the first score line 15.

The blank 10 further includes a back panel 18. A third score line 19 interconnects the back panel 18 to the second side panel 16 and extends parallel to the second score line 17. A front bottom flap 20 is provided, and a fourth score line 21 interconnects the front bottom flap 20 to the front panel 12 and extends perpendicularly to the first score line 15.

A first side bottom flap 22 is provided, and a fifth score line 23 interconnects the first side bottom flap 22 to the first side panel 14 and extends colinearly with the fourth score line 21. A second side bottom flap 24 is provided, and a sixth score line 25 interconnects the second side bottom flap 24 to the second side panel 16 and extends colinearly with the fifth score line 23.

A back bottom flap 26 is provided, and a seventh score line 27 interconnects the back bottom flap 26 to the back panel 18 and extends colinearly with the sixth score line 25. A front top flap 28 is provided, and an eighth score line 29 interconnects the front top flap 28 to the front panel 12 and extends perpendicularly to the first score line 15.

A first side top flap 30 is provided, and a ninth score line 31 interconnects the first side top flap to the first side panel 14 and extends colinearly with the eighth score line 29. A second side top flap 32 is provided, and a tenth score line 33 interconnects the second side top flap 32 to the second side panel 16. A back top flap 34 is provided, and an eleventh score line 35 interconnects the back top flap 34 to the back panel 18 and extends colinearly with the tenth score line 33.

The foregoing generally describes most conventional blanks which are to be converted into cases, the score lines representing regions along which the various adjacent flaps and panels can be folded without substantial resistance relative to one another. The invention herein lies principally in the provision of ear flap means separated from the front top flap 28 and interconnected to at least one of the side top flaps (30 or 32), the ear flap means extending at least partially across the front top flap 28 and being foldable relative to and independently of the side top flaps 30, 32 to which the ear flap means is interconnected.

In this respect, the ear flap means may be a single flap (as will be discussed below) but preferably includes in part a first ear flap 36 and a twelfth score line 37 interconnecting the first ear flap 36 to the side top flap 30, the twelfth score line 37 extending parallel to the first score line 15. The first ear flap 36 is cantilevered from the side top flap 30 to which it is connected and extends adjacent but is not connected to the front top flap 28 to partially bridge the side top flaps 30 and 32.

The ear flap means further includes a second ear flap 38 and a thirteenth score line 39 interconnecting the second ear flap 38 to the side top flap 32, the thirteenth score line 39 extending parallel to the twelfth score line 37. The second ear flap 38 is cantilevered from the side flap 32 to which it is connected and extends partially across (but unconnected to) the front top flap 28 to cooperatively, in essence, bridge with the first ear flap 36 the side top flaps 30 and 32.

B. Assembly

Figure 2:
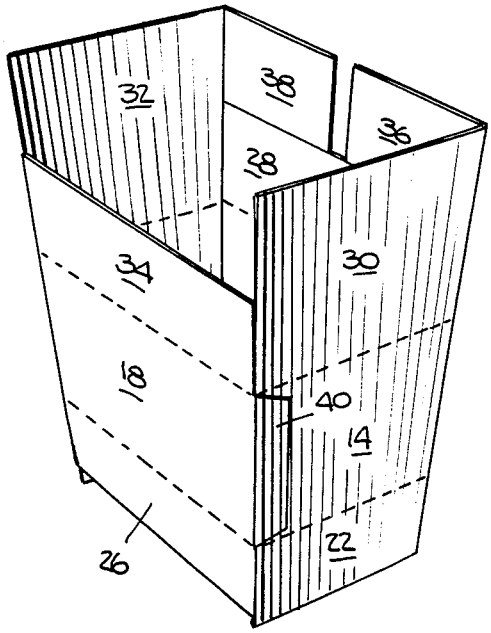
FIG. 2 is a perspective view of the blank of FIG. 1 of the present invention is an intermediary stage of folding.

Referring now to FIGS. 2–12, the blank of FIG. 1 may be assembled in the following manner. First, the blank can be folded along the score lines 15, 17 and 19 so that it appears in the form illustrated in FIG. 2. A tab 40 interconnected to the panel 18 by a score line 42 can be adhesively secured (such as by means of wet adhesive or the like) to the panel 14 to contrain the blank in a four-sided arrangement as illustrated in FIG. 2.

Figure 3:
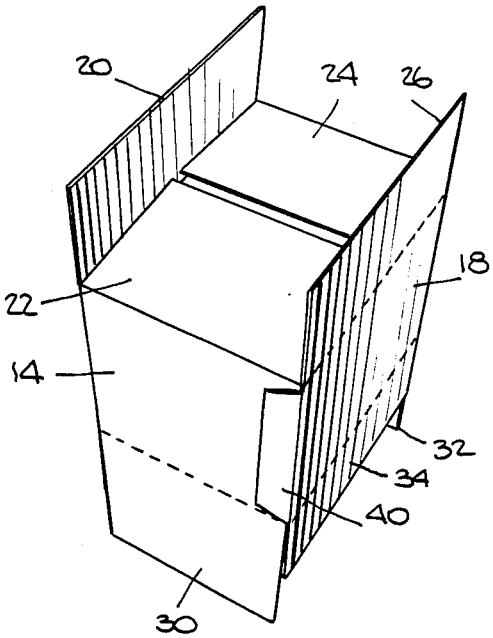
FIG. 3 is a perspective view of the partially folded case illustrating in FIG. 2 turned over to expose the bottom thereof.

Next, the blank 10 can be inverted so it appears as illustrated in FIG. 3. In this condition the front bottom flap 20 and the back bottom flap 26 can be folded over the side bottom flaps 22 and 24 and fastened thereto such as by means of an adhesive strip or pressure-sensitive tape 44 as illustrated in FIG. 4. The four-sided arrangement with a closed bottom of the blank 10 (now a partially formed case) can then be inverted once again so that it appears as illustrated in FIG. 5 with the side top flaps 30 and 32 in an elevated condition, and the ear flaps 36 and 38 readied for insertion into the bottom portion of the partially formed case illustrated in FIG. 6.

In this respect, the side top flaps 30 and 32 can be forcably bent along their respective score lines 31 and 33 into the partially formed case illustrated in FIG. 6, but in this instance with the ear flaps 36 and 38 bent at right angles relative thereto along their respective score lines 37 and 39. In this manner, the side top flaps 30 and 32 can be bent, one at a time, entirely downwardly into the case of FIG. 6 so as to engage, in face-to-face relation, the interior of the side panels 14 and 16, respectively. In turn, the ear flaps 36 and 38 will engage, in face-to-face relation, and bridge the span of the interior of the front panel 12. Once this is accomplished, the case will appear as illustrated in FIG. 7 and can accommodate, for example, twelve bottles 46 as illustrated in FIG. 8.

Figure 8:
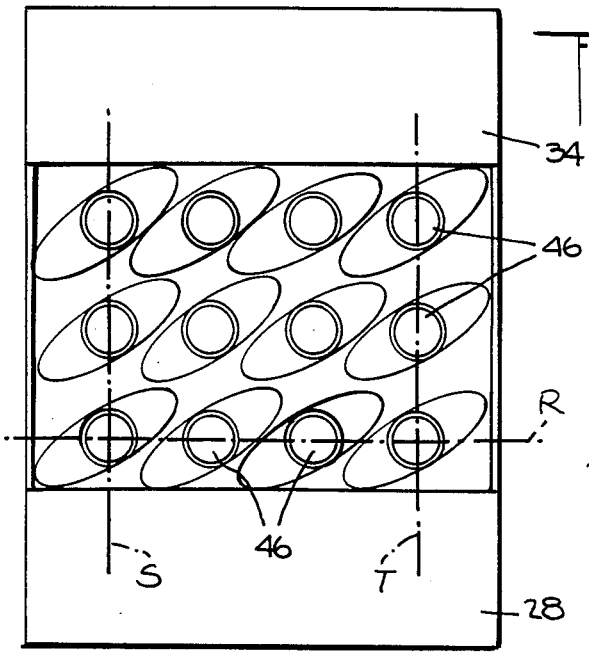
FIG. 8 is a top view of the case illustrated in FIG. 7 with bottles inserted therein.

In the condition of the case as illustrated in FIG. 8, the ear flaps 36 and 38 are located below the front top flap 28 and are interposed between the interior of the front panel 12 and the row of bottles R in FIG. 8 to protect the latter. Similarly, the side top flaps 30 and 32 are interposed between the interior of their associated side panels 14 and 16, respectively, and the rows S and T of the bottles 46 to protect the latter.

Figure 9:
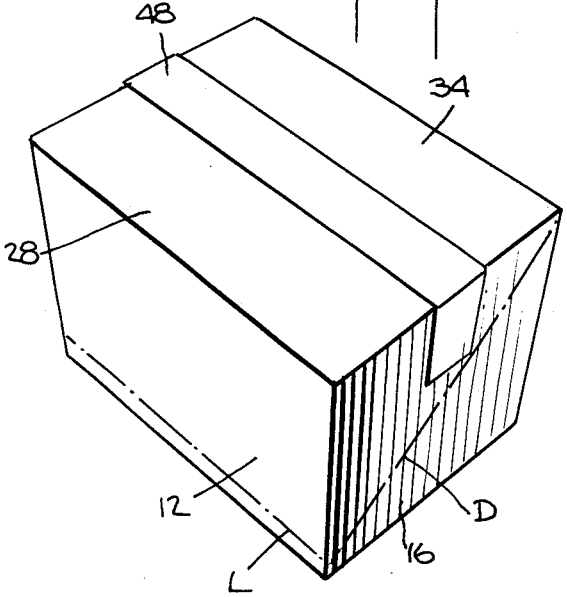
FIG. 9 is a perspective view of the fully closed case of the present invention.

The front bottom flap 34 and the front top flap 28 can then be folded along their respective score lines 35 and 29 to overlie the bottles 46 in a manner as illustrated in FIG. 9. Once in this condition, an adhesive strip or pressure-sensitive tape 48 can be applied along the marginal edges of the flaps 34 and 28 to secure them in a closed condition relative to the case.

As further illustrated in FIG. 9, the exterior of the case of the blank 10 can be provided with a number of reference lines to define where the case may be later sliced to remove an upper portion thereof from the lower portion and expose the contents of the case for display purposes in a sales outlet. In this respect, the exterior of the case of the blank 10 may be provided with a diagonal reference line D along the side panel 16, an identically located reference line (not shown) on the side panel 14, and a lower reference line L along the front panel 12 whose opposite ends meet the reference lines D at the score lines 15 and 17.

The case then can be sliced open by a proprietor of a sales outlet along the two reference lines D, the reference line L, and along the score line 35 interconnecting the flap 34 to the panel 18.

The ear flaps 36 and 38 serve to shield the faces of the bottles 46 in the row R of the bottles from the sharp edge of a slicing blade, whereas the top flaps 30 and 32 serve to protect the bottles 46 in the rows S and T, respectively, from the blade. What in fact occurs is that only the front panel 12 and side panels 14 and 16 are sliced entirely through. The ear flaps 36 and 38 and the side top flaps 30 and 32 are not sliced of if so then only partially.

Figure 11:
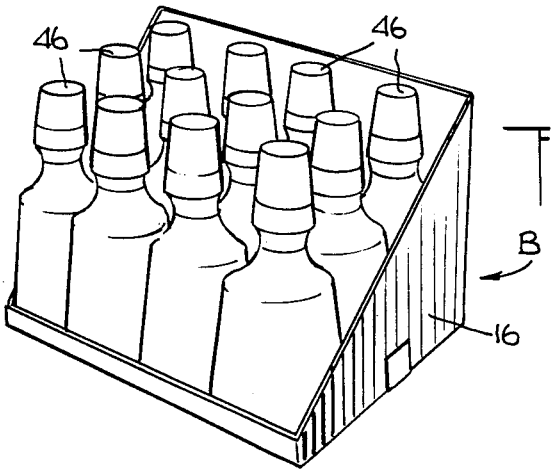
FIG. 11 is a perspective view of the lower portion of the case of FIG. 10 with the contents fully exposed; and, FIG. 12 is a perspective view of the case of FIG. 11 from which all bottle contents have been removed.
Figure 10:
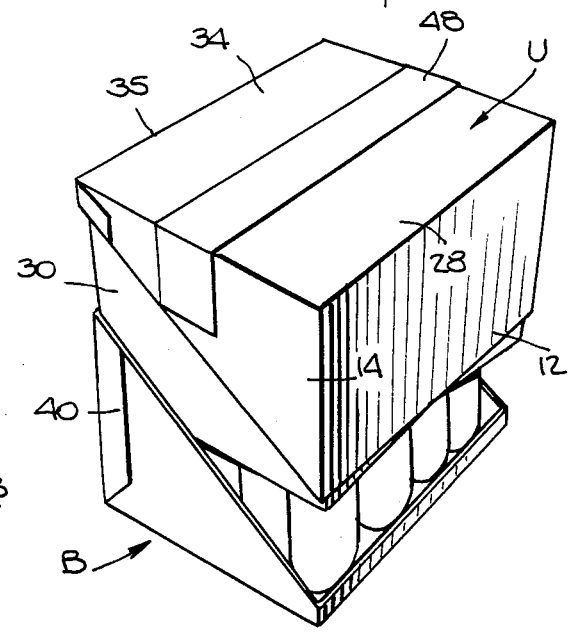
FIG. 10 is a perspective view of the case of the present invention after the upper portion has been sliced diagonally and lifted partially upwardly from the lower portion.
Figure 12:
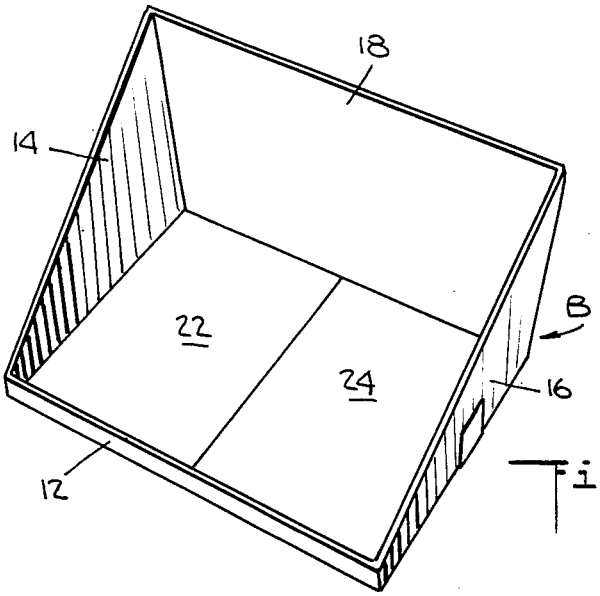

As a consequence, the case of the blank 10 will be divided into an upper portion U and a bottom portion B, each of which from the side appears to be somewhat triangular as illustrated in FIG. 10. The upper portion U can then be entirely removed from the bottom portion B of the case of the blank 10 so that there remains the bottom portion B displaying its bottle contents 46 as illustrated in FIG. 11. FIG. 12 illustrates the bottom portion B of the case of the blank 10 with all of the bottle contents having been removed therefrom.

As is well understood, the side panels 30 and 32 together with the ear flaps 36 and 38, when folded into the case of the blank 10 as illustrated in FIG. 6 to a position as illustrated in FIG. 7, function to entirely protect the bottle contents from the edge of a cutting blade to foster conversion of the shipping case to a display case.

Figure 1A:
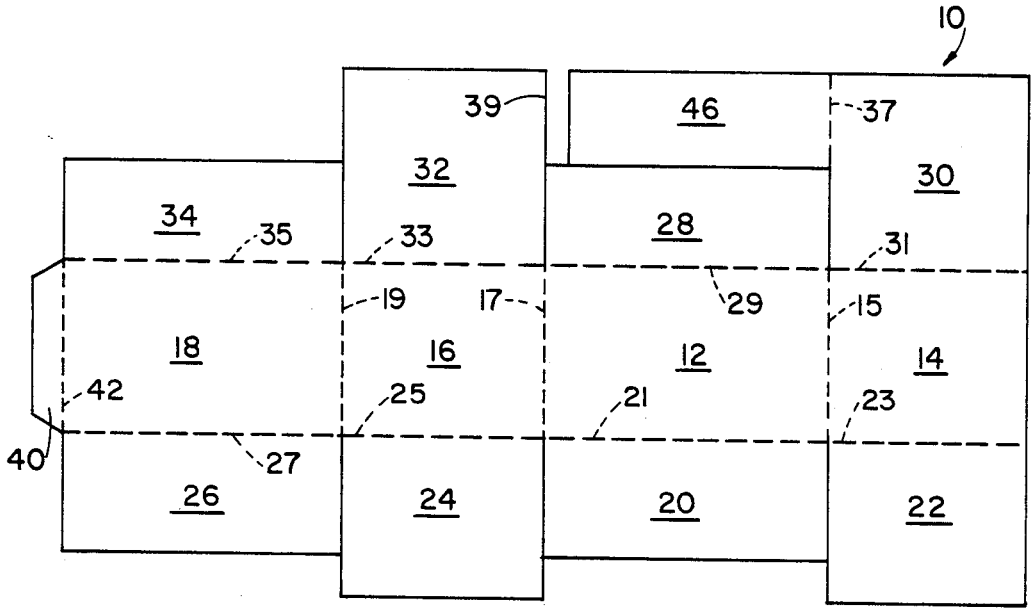
FIG. 1A is a plan view illustrating another embodiment of the blank of the present invention before folding.

While the ear flaps 36 and 38 have been described as being separate from one another, the present invention as shown in FIG. 1*a* contemplates the use of a single ear flap 46 the length of which corresponds to the combined lengths of the ear flaps 36 and 38 between the side top flaps 30 and 32, in this instance the single ear flap 46 being connected to the side top flap 30. Alternatively, the single ear flap 46 may be connected to the side top flap 32. In addition, a further ear flap can be secured to the other side of the side top flap 32 to extend coincidentally along and above the full length of the back top flap 34. In this manner, the front and back panels 12 and 18 of the case of the blank 10 can be protected from the sharp edge of a cutting blade, the front panel 12 along the lower reference line L and the back panel 18 along the score line 35.

Having thus set forth the nature of the present invention, together with certain modifications thereof, still other variations thereof are contemplated as being part of the present invention if encompassed by the following claims appended hereto.

What is claimed is:

1. In a corrugated fiberboard blank for being folded into a product shipping case and converted subsequently to a product display case, said blank including a front panel, a first side panel, a first score line interconnecting said first side panel to said front panel, a second side panel, and a second score line interconnecting said second side panel to said front panel and extending parallel to said first score line, a back panel, a third score line interconnecting said back panel to said second side panel and extending parallel to said second score line, a front bottom flap, a fourth score line interconnecting said front bottom flap to said front panel and extending perpendicularly to said first score line, a first side bottom flap, a fifth score line interconnecting said first side bottom flap to said first side panel and extending colinearly with said fourth score line, a second side bottom flap, a sixth score line interconnecting said second side bottom flap to said second side panel and extending colinearly with said fifth score line, a back bottom flap, a seventh score line interconnecting said back bottom flap to said back panel and extending colinearly with said sixth score line, a front top flap, an eighth score line interconnecting said front top flap to said front panel and extending perpendicularly to said first score line, a first side top flap, a ninth score line interconnecting said first side top flap to said first side panel and extending colinearly with said eighth score line, a second side top flap, a tenth score line interconnecting said second side top flap to said second side panel, a back top flap, an eleventh score line interconnecting said back top flap to said back panel and extending colinearly with the tenth score line, each of said flaps being separated from and foldable independently of the others of said flaps relative to said panels, an improvement comprising: ear flap means separated from said front top flap and interconnected to at least one of said side top flaps, said first and second top flaps having free edges opposite said ninth and tenth score lines, respectively, said ear flap means having an edge means substantially aligned with said free edges said ear flap means having an edge opposite said edge means substantially coincident with the edge of said front top flap opposite said eighth score line and extending at least partially across said front top flap and being foldable relative to and independently of the one of said side top flaps to which said ear flap means is interconnected.

2. In a blank as claimed in claim 1, wherein said ear flap means includes a first ear flap and a twelfth score line interconnecting said first ear flap to one of said side top flaps, said twelfth score line extending parallel to said first score line.

3. In a blank as claimed in claim 2, wherein said first ear flap is cantilevered from said side top flap to which it is connected and extends substantially across said front top flap to substantially bridge said side top flaps.

4. In a blank as claim in claim 2, wherein said ear flap means includes a second ear flap and a thirteenth score line interconnecting said second ear flap to the other one of said side top flaps, said thirteenth score line extending parallel to said twelfth score line.

5. In a blank as claimed in claim 4, wherein said second ear flap is cantilevered from the other one of said side flaps to which it is connected and extends partially across said front top flap to substantially bridge with said first ear flap said side top flaps.

6. In a blank as claimed in claim 5, wherein said first and second ear flaps are separated from one another substantially at the midsection of said front top flap.

* * * * *